US007950472B2

(12) United States Patent
DiFoggio et al.

(10) Patent No.: US 7,950,472 B2
(45) Date of Patent: May 31, 2011

(54) DOWNHOLE LOCAL MUD WEIGHT MEASUREMENT NEAR BIT

(75) Inventors: Rocco DiFoggio, Houston, TX (US); Jinsong Zhao, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 86 days.

(21) Appl. No.: 12/372,282

(22) Filed: Feb. 17, 2009

(65) Prior Publication Data

US 2009/0205822 A1 Aug. 20, 2009

Related U.S. Application Data

(60) Provisional application No. 61/029,762, filed on Feb. 19, 2008.

(51) Int. Cl.
*E21B 47/00* (2006.01)

(52) U.S. Cl. ..... 175/38; 175/48

(58) Field of Classification Search ..... 175/24, 175/38, 40, 48

See application file for complete search history.

(56) References Cited

U.S. PATENT DOCUMENTS

| | | | | |
|---|---|---|---|---|
| 4,201,082 | A * | 5/1980 | Dockhorn et al. | 73/152.42 |
| 4,267,726 | A | 5/1981 | Noik | |
| 4,867,254 | A | 9/1989 | Gavignet | |
| 5,070,949 | A | 12/1991 | Gavignet | |
| 5,080,182 | A | 1/1992 | Thompson | |
| 6,176,323 | B1 * | 1/2001 | Weirich et al. | 175/40 |
| 6,814,142 | B2 | 11/2004 | Paulk et al. | |
| 7,021,405 | B2 | 4/2006 | Proett et al. | |
| 2005/0194184 | A1 * | 9/2005 | Gleitman | 175/45 |
| 2008/0060846 | A1 * | 3/2008 | Belcher et al. | 175/25 |

* cited by examiner

*Primary Examiner* — William P Neuder
(74) *Attorney, Agent, or Firm* — Cantor Colburn LLP

(57) ABSTRACT

A method for detecting a change in a wellbore fluid includes estimating at least two pressure differences in the wellbore fluid and estimating a change in a density of the fluid using the at least two pressure differences. The density change may be estimated by the equation, $\Delta\rho=(\Delta P_{before_influx}-\Delta P_{after_influx})/(g\times\Delta TVD)$, wherein $\Delta P$ is a fluid pressure difference between two points along the wellbore, $\rho$ is a mean value of density of the fluid between the two points, g is gravity and $\Delta TVD$ is a vertical distance between the two points. The method may include estimating a density change using an estimated inclination of the wellbore. An apparatus for estimating density changes includes at least two axially spaced apart pressure sensors. The sensor positions may be switched to estimate a correction term to reduce a relative offset between the two pressure sensors.

19 Claims, 4 Drawing Sheets

DOWNHOLE LOCAL MUD WEIGHT MEASUREMENT NEAR BIT

CROSS-REFERENCE TO RELATED APPLICATIONS

This application takes priority from the U.S. Provisional Application Ser. No. 61/029,762, filed on Feb. 19, 2008.

BACKGROUND OF THE DISCLOSURE

1. Field of the Disclosure

This disclosure relates generally to oilfield downhole tools and more particularly to methods and devices for enhanced directional drilling of wellbores.

2. Description of the Related Art

During construction or servicing of a hydrocarbon producing well, an operator can encounter a number of undesirable conditions that can pose a hazard to equipment and personnel. One undesirable condition is a "kick." During drilling, a high pressure formation fluid can invade the well bore and displace drilling fluid from the well. The resulting pressure "kick" can lead to a well blow-out at the surface. Conventionally, during drilling, the mud weight of a drilling fluid circulated in the well is selected to provide a hydrostatic pressure that minimizes the risk and impact of a "kick." Additionally, drilling rigs use surface blowout preventers to protect against the uncontrolled flow of fluids from a well. When activated, blowout prevention systems "shut-in" a well at the surface to seal off and to thereby exert control over the kick. A typical blowout preventer system or "stack" usually includes a number of individual blowout preventers, each being designed to seal the well bore and withstand pressure from the wellbore. Another undesirable condition is a loss of drilling fluid into a formation. That is, in some instances, the drilling fluid pumped into the wellbore is at a pressure that causes some or all of the drilling fluid to penetrate into the formation rather than flow back up to the surface. A loss is usually treated by circulating a lost circulation material (LCM) into the wellbore. The LCM usually includes particles that plug and seal the fractured or weak formation. Yet another undesirable condition is an underground blowout, which is generally understood as an undesirable subsurface cross flow between two reservoirs intersected by a wellbore. Such a cross flow can be caused when a drilling crew activates a surface blowout preventer to suppress and control a kick. The shut-in well can cause an annulus pressure increase that fractures one or more zones in an open hole region. Drilling fluid is then lost to this fractured zone. This condition can require a combination of measures, including the use of LCM and well shut-in, to control.

The corrective measures discussed above, and other corrective measures known in the art, may be most effective when they are instituted as quickly as possible after the occurrence of a wellbore instability. Thus, there is a need for methods, systems and devices that may provide early indications of wellbore instabilities as well as other out-of-norm conditions.

SUMMARY OF THE DISCLOSURE

In aspects, the present disclosure provides a method for detecting a change in a fluid in a wellbore. In one embodiment, the method includes estimating a first and a second pressure difference in the fluid in the wellbore; and estimating a change in a density of the fluid using the first and the second pressure differences. In some embodiments, the change in density is in part estimated by the equation, $\Delta\rho=(\Delta P_{before_influx}-\Delta P_{after_influx})/(g\times\Delta TVD)$, wherein $\Delta P$ is a fluid pressure difference between a first and second point along the wellbore, $\rho$ is a mean value of density of the fluid between the first and the second point, g is gravity and $\Delta TVD$ is a vertical distance between the first and the second point. Also, the method may include estimating an inclination along the wellbore, and estimating a change in the density using the estimated inclination. An exemplary apparatus deployed in connection with the method may include at least two axially spaced apart pressure sensors to estimate the first and the second pressure differences. In one arrangement, the method may further include the steps of switching the positions of the two pressure sensors; measuring pressure with the two pressure sensors in their switched positions; estimating a correction term using the pressure measurement of the two pressure sensors in their switched and unswitched positions; and applying the estimated correction term to the measurements of the pressure sensors to reduce a relative offset between the two pressure sensors.

For drilling related applications, the method may include positioning the two pressure sensors on a drill string; and drilling the wellbore with the drill string. A method for such applications may include the steps of conveying a processor with a drilling string into a wellbore. The processor may be programmed to estimate the change in the density of the fluid. The method may further include instituting a corrective action for controlling a fluid flow in the wellbore in response to an estimated change in density. Exemplary corrective actions include: (i) sealing off the well to stop fluid flow, (ii) circulating a loss circulation material, (iii) changing a mud weight of a drilling fluid circulated in the wellbore.

In aspects, the present disclosure also provides a method for detecting a change in a fluid in a wellbore that includes estimating a change in a density of the fluid in the wellbore using at least four measured pressures in the fluid. The at least four measured pressures may include a first set of pressures measured at a first time and a second set of pressures measured at a second time different from the first time. The method may further include estimating a first pressure difference using the first set of pressures and estimating a second pressure difference using the second set of pressures. The density may be estimated using the estimated first and second pressure differences.

In aspects, the present disclosure further provides a computer-readable medium for detecting a change in a fluid in a wellbore. The medium may include instructions that enable at least one processor to: estimate a first and a second pressure difference in the fluid in the wellbore; and estimate a change in a density of the fluid using the first and the second pressure differences. The instructions may estimate the change in density in part by using the equation, $\Delta\rho=(\Delta P_{before_influx}-\Delta P_{after_influx})/(g\times\Delta TVD)$, wherein $\Delta P$ is a fluid pressure difference between a first and second point along the wellbore, $\rho$ is a mean value of density of the fluid between the first and the second point, g is gravity and $\Delta TVD$ is a vertical distance between the first and the second point.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
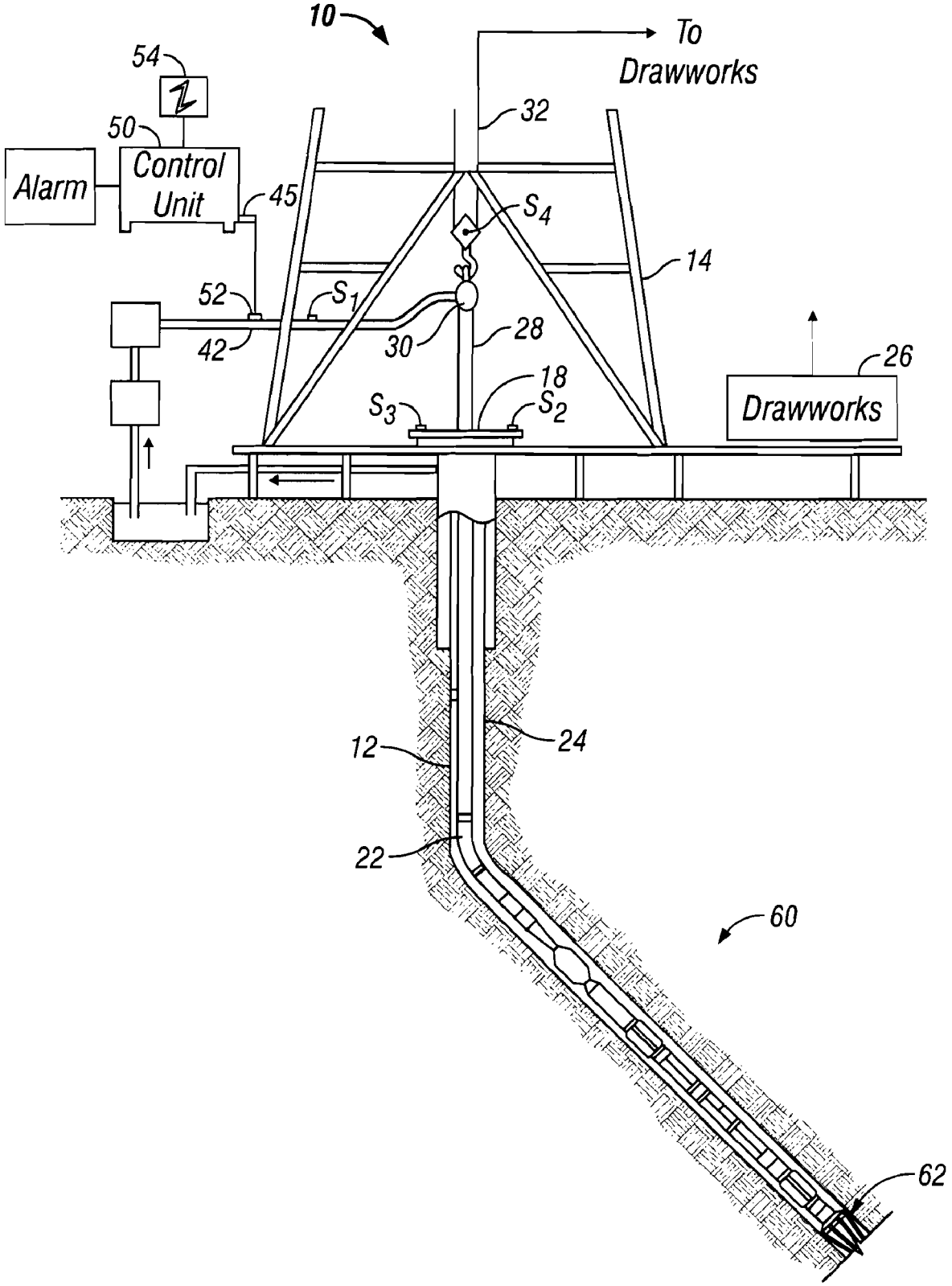
FIG. 1 illustrates a drilling system made in accordance with one embodiment of the present disclosure.

The present disclosure relates to devices and methods for obtaining estimations of changes in drilling fluid density at or near a drill bit or elsewhere along a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring now to FIG. 1, there is shown an embodiment of a drilling system 10 utilizing a bottomhole assembly (BHA) 60 configured for drilling wellbores. As will be appreciated from the discussion below, the present disclosure provides methodologies and systems for estimating mud density changes in a wellbore. Because the density changes are measured in situ, corrective actions for controlling out-of-norm conditions detected by the estimation of in situ fluid density may be undertaken soon after the onset of such out-of norm conditions rather than hours later when gas-laden mud has finally circulated to the surface and it may be too late to take preventive action such as increasing mud weight.

In one embodiment, the system 10 shown in FIG. 1 includes a bottomhole assembly (BHA) 60 conveyed in a borehole 12 as part of a drill string 22. The drill string 22 includes a jointed tubular string 24, which may be drill pipe or coiled tubing, extending downward into the borehole 12 from a rig 14. The drill bit 62, attached to the drill string end, disintegrates the geological formations when it is rotated to drill the borehole 12. The drill string 22, which may be jointed tubulars or coiled tubing, may include power and/or data conductors such as wires for providing bi-directional communication and power transmission. The drill string 22 is coupled to a drawworks 26 via a kelly joint 28, swivel 30 and line 32 through a pulley (not shown). The operation of the drawworks 26 is well known in the art and is thus not described in detail herein. While a land-based rig is shown, these concepts and the methods are equally applicable to offshore drilling systems. A surface controller 50 receives signals from the downhole sensors and devices via a sensor 52 placed in the fluid line 42 and signals from sensors $S_1$, $S_2$, $S_3$, hook load sensor $S_4$ and any other sensors used in the system and processes such signals according to programmed instructions provided to the surface controller 50. The surface controller 50 displays desired drilling parameters and other information on a display/monitor 54 and is utilized by an operator to control the drilling operations. A communication system for transmitting uplinks and downlinks may include a mud-driven power generation units (mud pursers), or other suitable two-way communication systems that use hard wires (e.g., electrical conductors, fiber optics), acoustic signals, or electromagnetic signals such as radio frequency (RF) signals.

Figure 2:
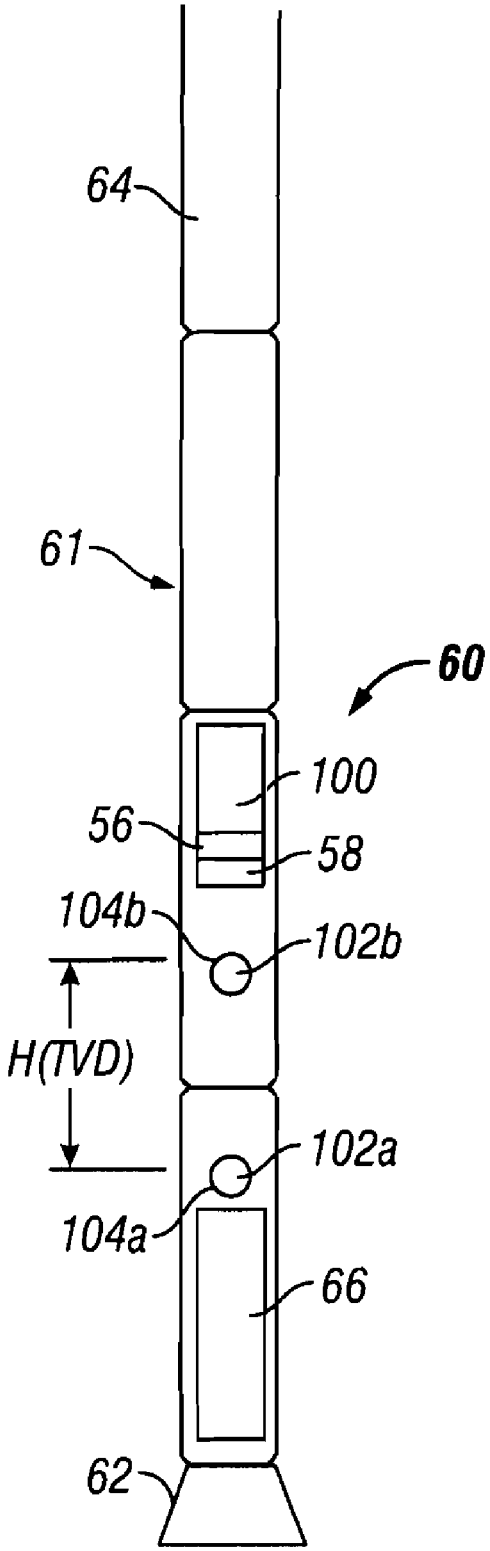
FIG. 2 illustrates in schematic format a BHA having a processor programmed to estimate a change in fluid density in accordance with one embodiment of the present disclosure.

Referring now to FIG. 2, there is shown in greater detail certain elements of the BHA 60. The BHA 60 carries the drill bit 62 at its bottom or the downhole end for drilling the wellbore and is attached to a drill pipe 64 at its uphole or top end. A mud motor or drilling motor 66 above or uphole of the drill bit 62 may be a positive displacement motor, which is well known in the art. A turbine may also be used. Fluid supplied under pressure via the drill pipe 64 energizes the motor 66, which rotates the drill bit 62.

The BHA 60 may include a formation evaluation sub 61 that may includes sensors for estimating parameters of interest relating to the formation, borehole, geophysical characteristics, borehole fluids and boundary conditions. These sensor include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid. The BHA 60 may also include a processor 100, sensors 56 configured to measure various parameters of interest, and one or more survey instruments 58, all of which are described in greater detail below.

In aspects, the BHA 60 may include a processor 100 programmed to determine or estimate a density or a change in a density of a fluid in the wellbore. The processor 100 may be configured to decimate data, digitize data, and include suitable programmable logic circuits (PLC's). For example, the processor may include one or more microprocessors that use a computer program or instructions implemented on a suitable machine-readable medium that enables the processor to perform the control instruments and process data. The machine-readable medium may include ROMs, EPROMs, EAROMs, Flash Memories and Optical disks.

In one arrangement, the processor 100 determines changes in density using measurements received from two axially spaced-apart pressure sensors 102*a*, 102*b*. The pressure sensor 102*a* is positioned at point 104*a* and the pressure sensor 102*b* is positioned at point 104*b*. The distance separating the points 104*a* and 104*b* may be fixed or adjustable, but is known. These sensors may include pressure sensors that have accuracies on the order of 0.02% to 0.04% of full scale and resolution on the order of 0.008-0.010 PSI. At high downhole pressures (on the order of 10 000 PSI), these gauge accuracy limits correspond to offset errors in the pressure readings that are likely to be on the order of several PSI, which is more than 100 times worse than the gauge resolution. Pure water corresponds to a pressure gradient of 0.434 PSI per vertical foot. A heavy drilling fluid, with many suspended solids, could be 0.9 PSI/ft. If the pressure gauges are located 10 vertical feet apart, then the difference in pressure readings would be only 9 PSI, even for a heavy mud. Therefore, a several PSI offset error in each gauge would lead to a very inaccurate density as calculated from pressure gradient. However, when we are only interested in the change in drilling fluid density associated with the influx of gas rather than the drilling fluid density itself, it is gauge resolution rather than gauge accuracy that limits one's measurement capability. That is, although there may be substantial error in the density that is computed from the difference in pressure readings of two gauges located a known vertical distance apart, the error in the change in density before and after gas influx can be 100 times more accurate than the density measurement, which is one key concept underlying this disclosure. Using pre-programmed instructions or mathematical model, the processor 100 may estimate or calculate a density or density change of a fluid flowing in the annulus 24 (FIG. 1) and proximate to the drill bit 62. During drilling, a formation fluid such as a gas or hydrocarbon may invade a wellbore 12 (FIG. 1). The invading formation fluid reduces the density of the drilling fluid and in particular the drilling fluid returning to the surface via the annulus 24 (FIG. 1) (hereafter, the "return fluid"). As is known, drilling fluid may be formulated to have a specified density for purposes such as controlling bottomhole pressure condition; e.g., to cause an at-balanced or overbalanced condition. Gas influx reduces the density of drilling fluid. Simply for the purpose of illustrating this concept, we can use the NIST Supertrapp computer program and let some pure hydrocarbon (with no mud solids) such as dodecane (C12) represent drilling fluid. If 4% by weight of methane is mixed into dodecane at some elevated temperature (100 C) and pressure (8000 PSI), then the density of this gas-liquid mixture is reduced by about 2% relative to the pure liquid dodecane density of 0.7225 g/cc, (which corresponds to a pressure difference of 3.132 PSI over ten vertical feet). Then, the change in the difference of the pressure readings of two gauges (separated by ten vertical feet) before and after gas influx would be 0.063 PSI, which is almost ten times the gauge resolution, so such gas influx would be detectable. In embodiments, the sensors 102*a,b* may be used to detect changes in a mud pressure gradient between points 104*a,b*. In an illustrative model, a mud pressure gradient between a point 104*a* associated with sensor 102*a* and a point 104*b* associated with sensor 102*b* may be expressed as:

$$\Delta P=(\rho\times g\times\Delta TVD) \quad (1)$$

Furthermore, by subtracting the pressure difference between the two gauges after gas influx from the pressure difference before gas influx, we can compute the change in drilling fluid density, $\Delta\rho$.

$$\Delta\rho=(\Delta P_{before_influx}-\Delta P_{after_influx})/(g\times\Delta TVD) \quad (2)$$

In equation (1), $\Delta P$ is the mud pressure gradient or pressure difference between points 104*a* and 104*b*, $\rho$ is a mean value of density of the fluid between points 104*a, b*, g is gravity and $\Delta TVD$ is the change in true vertical depth between points 104*a* and 104*b*. Of course, if the tool is not vertical, but at an angle of $\theta$ with respect to vertical (as measured by the tool's internal inclinometer), then $\Delta TVD$ can be calculated as the product of the distance (along the tool) between the two pressure gauges and the cosine of $\theta$. The sensors 102*a,b* provide the pressures at points 104*a,b* respectively and thus provide an estimated value of $\Delta P$. The processor 100 may receive directional survey measurements from survey instruments such as inclinometers or three (3) axis accelerometers to determine inclination, or the angular deviation for a horizontal or vertical datum. The determined inclination may then be used to determine the vertical leg or vertical distance separating points 104*a,b*. Thus, $\rho$ may be calculated based on measurements made by the pressure sensors and the directional survey tools. In embodiments, discrete values for $\rho$ are continually calculated and monitored for variations that may exceed a preprogrammed threshold.

It should be appreciated that estimating changes in density by determining the differences in downhole pressure measurements may reduce the impact of system errors associated with the sensors or the inherent operational limitations of such sensors. By way of explanation, a measurement offset error associated with pressure readings P1 and P1' taken at two separate times by first sensor 102*a* may be $\xi$1 and a measurement offset error associated with pressure readings P2 and P2' taken at two separate times by a second sensor 102*b* may be $\xi$2. The two sensors may be vertically separated by a height h. These pressure offset errors, $\xi$1 and $\xi$2 are not expected to change over the fairly short times (seconds to minutes) between successive pressure readings. Then, the change in density or $\Delta\rho$ between these two points may be expressed as:

$$\{[P1'+\xi1-(P2'+\xi2)]-[P1+\xi1-(P2+\xi2)]\times g\times h=\Delta\rho \quad (3)$$

As should be evident in equation (3), the pressure offset errors $\xi$1 and $\xi$2 cancel out and are eliminated from the calculation of the change in density.

Figure 3:
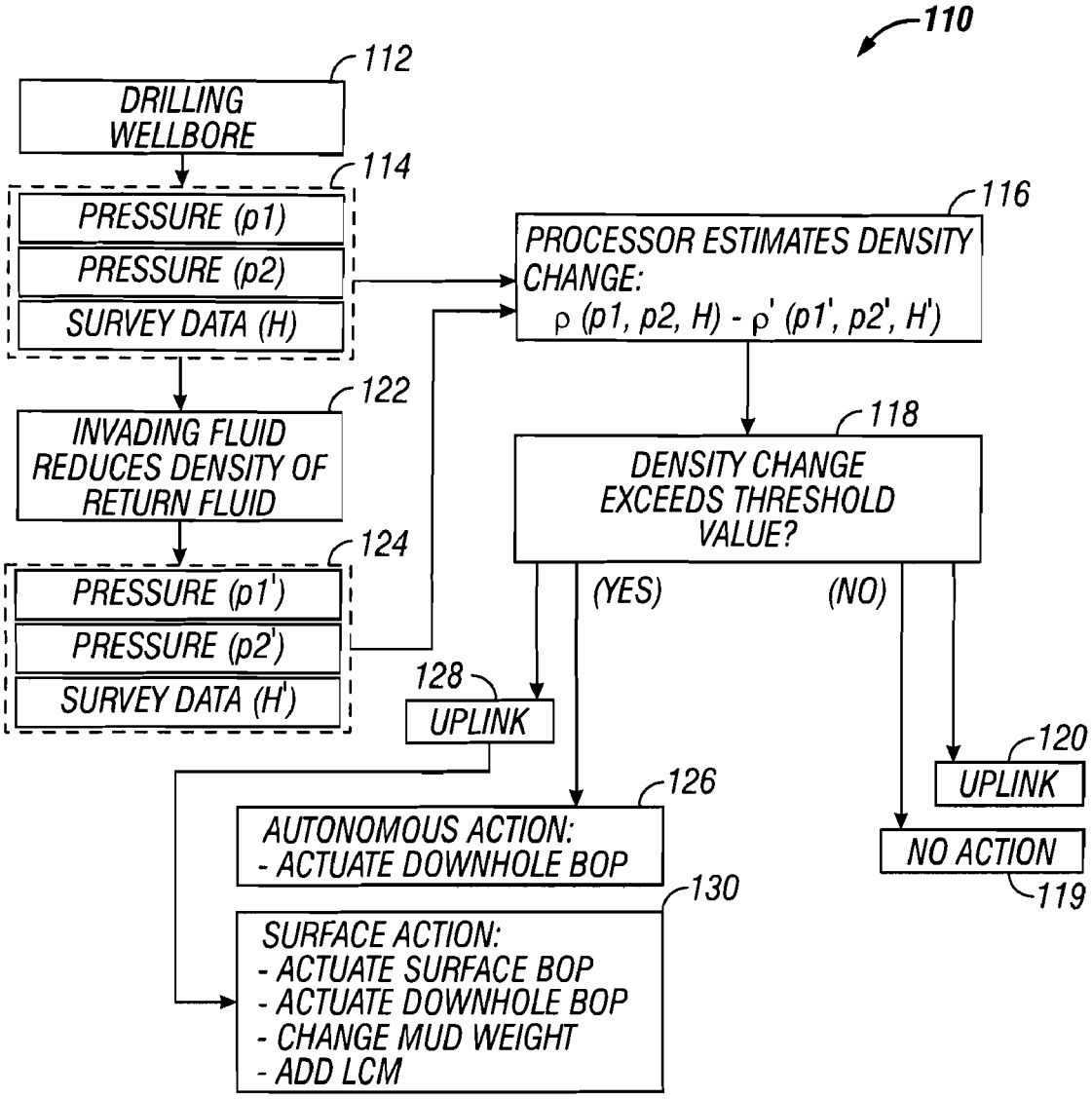
FIG. 3 illustrates in flowchart format an exemplary method for estimating a change in density of a fluid in a wellbore.

Referring now to FIG. 3, there is shown an illustrative method 110 for early in situ detection of changes in return fluid density. The method begins with drilling the wellbore at step 112. While drilling, at step 114, a processor receives pressure data from two spaced apart pressure sensors and receives inclination measurements from survey instruments that may be used to determine the vertical distance separating the two pressure sensors. At step 116, the processor determines a first $\rho$ using the pressure data P1 and P2 and vertical distance h. As long as the processor determines that the estimations of return fluid density indicate density changes that are within established numerical norms at step 118, the processor may be programmed to not take any action at step 119 or periodically transmit an uplink with unprocessed data and/or data representative of the determined density at step 120. At step 122, a formation fluid such as gas or oil may enter the wellbore being drilled. The invading formation fluid reduces the density of the return fluid, which changes a pressure in the return fluid. At step 124, the pressure sensors and survey instrument measure and supply the pressure data and inclination at the time of or subsequent to the fluid invasion. Thus, at step 116, when performed by the processor, may indicate a second $\rho$ using the pressure data P1' and P2' and vertical distance h'. Due to the fluid invasion, the estimated second $\rho$ may different from the estimated first $\rho$ in an amount that exceeds a threshold value. The threshold value may be a preset value or a value that may be dynamically updated to reflect prevailing wellbore conditions and drilling parameters; e.g., the value may be changed to account for a change in drilling mud weight. If, at step 118, the processor determines that the $\rho$ has changed significantly, then the processor may be programmed to automatically initiate corrective action downhole at step 126; e.g., closing a valve or activating a downhole blowout preventer (BOP). In conjunction with such self-initiated action or in an alternative to self-initiated action, the processor may transmit an uplink at step 128 that includes data related to the density estimations. In embodiments, the processor may also transmit "raw" or unprocessed data such as the pressure measurements and survey data. At step 130, surface personnel can initiate actions such as activating surface BOP's, change drilling mud weight, or circulate lost circulation material (LCM). It should be appreciated that the in situ determination of density changes downhole enables corrective actions to be implemented at a relatively early stage of the out-of-norm condition.

It should be understood that the method 110 may be applicable in a variety of situations. For example, rather than fluid invasion, a change in pressure may be caused by loss of fluid into a formation having a relatively low pore pressure, or "thief zone." The density estimations of the method 110 may be utilized to identify those types of wellbore instabilities as well. Additionally, while FIG. 2 depicts the pressure sensors near the drill bit 62, it should understood that the pressure sensors may be distributed along some or all of the length of the drill string 64. Further, while the density estimation systems have been described in the context of a drilling system, such systems may be also applied in completed and producing wells and may be placed in a stationary location (e.g., cement shoe or casing) rather than along the drill string 64. For example, embodiments of the present disclosure may be utilized in "intelligent well" completions that control parameters such as flow rates in response to changes in wellbore conditions (e.g., water coning). Moreover, such systems may be utilized along fluid conduits such as flowlines, risers, and pipes.

Figure 4:
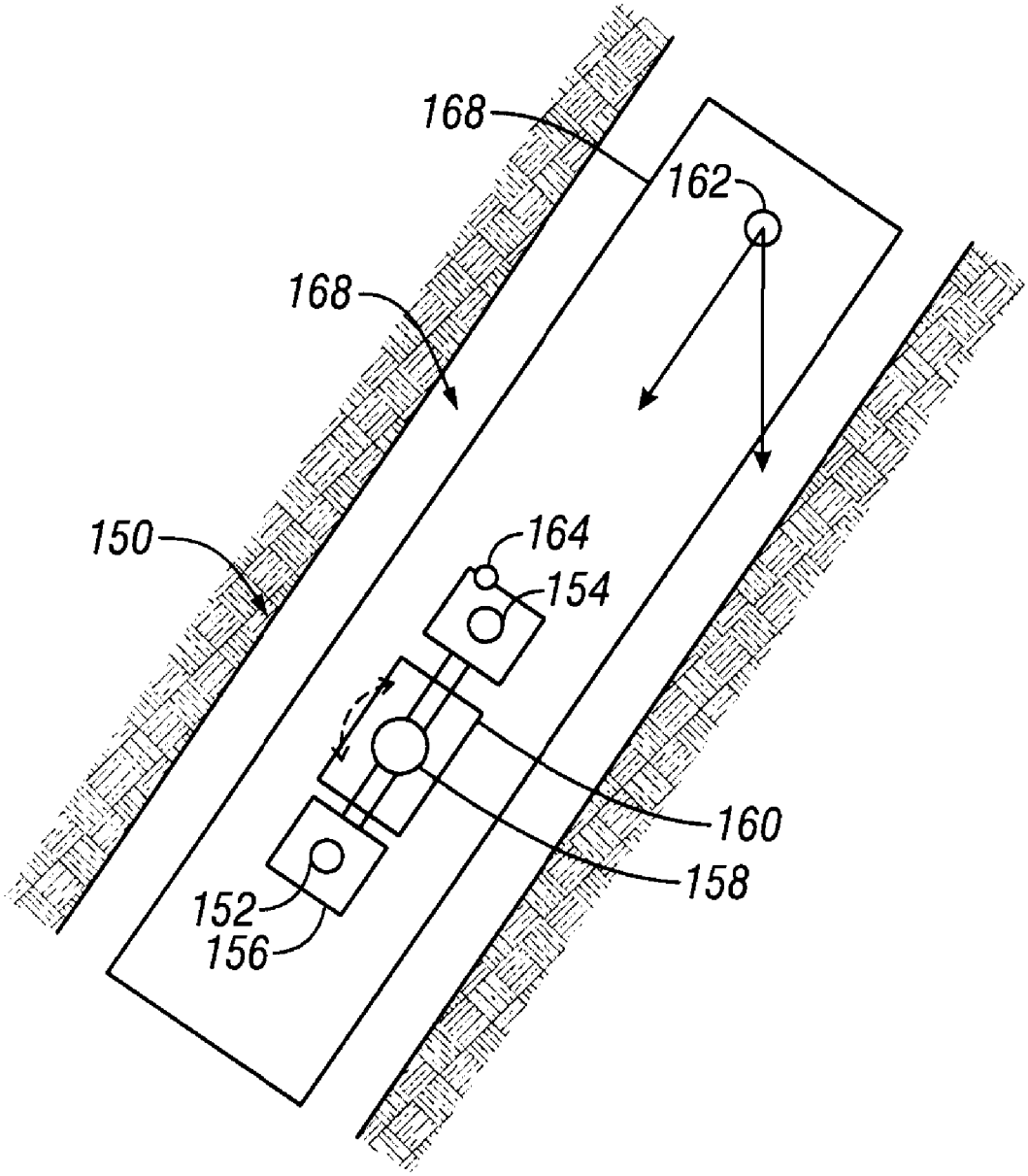
FIG. 4 schematically illustrates one embodiment of a sensor device made in accordance with the present disclosure.

Referring now to FIG. 4, there is shown one illustrative embodiment of a sensor system 150 made in accordance with the present disclosure. The sensor system 150 may be configured to provide pressure data and survey data (e.g., inclination) to a downhole processor 100 (FIG. 2) and/or to a transmitter (not shown) that uplinks the data to the surface for processing. The sensor system 150 may include a first pressure sensor 152 and a second pressure sensor 154, both of which are mounted on opposite ends of a switching member 156. The pressure sensors may include strain gauges, transducers, or other suitable sensing elements. The switching member 156 may be configured to spin or rotate about a center 158 when actuated by a suitable actuator 160. The actuator may be electrically activated and use devices such as an electric motor, biasing elements, or magnet to rotate the switching member 156. In one arrangement, the switch member 156 is configured to rotate one hundred eighty degrees to reverse the positions the first pressure sensor 152 and the second pressure sensor 154.

The sensor system 150 may also include a survey instrument 162 such as an inclinometer that may be used to determine a vertical distance separating the pressure sensors 152 and 154. Other sensors, such as a temperature sensor 164, may also be used with the sensor system 150. The sensor system 150 may be positioned on a conveying device 168 that may be coupled to a drill string made of jointed tubulars or coiled tubing. Non-rigid carriers such as a wireline or a slick line may also be utilized as a conveyance device.

During operation, a first set of pressure readings are taken by the first pressure sensor 152 and the second pressure sensor 154. Next, the switching device is actuated to reverse the positions of the first and second pressure sensors 152, 154. In this reversed position, a second set of pressure readings are taken by the first pressure sensor 152 and the second pressure sensor 154. An inter-calibration may then be performed using the first and second set of pressure readings. For example, the first pressure sensor 152 in a lower position may read a pressure $P_{al}$ while the second pressure sensor 154 in an upper position may read a pressure $P_{bu}$. After the switch, the first pressure sensor 152 in the upper position may read a pressure $P_{au}$ while the second pressure sensor 154 in a lower position may read a pressure $P_{bl}$. Thus, the pre-switch and post-switch measured pressure differences may be expressed as $(P_{au}-P_{bu})$ and $(P_{al}-P_{bl})$. To reduce or eliminate a relative offset between the two gauges and so allow one to calculate a correct fluid density from the difference of their readings, one can either add the difference of the two gauge's readings taken when they are at the same location to the first gauge and leave the second gauge's reading unchanged (make the first gauge read like the second gauge) or, alternatively, subtract this difference in readings from the second gauge and leave the first gauge's readings unchanged (make the second gauge read like the first gauge). In the event of a change in temperature or other wellbore condition that impacts offset, the switching and inter-calibration may be repeated.

From the above, it should be appreciated that what has been disclosed includes, in part, a method for detecting a change in a fluid in a wellbore. An illustrative method may include estimating a first and a second pressure difference in the fluid in the wellbore; and estimating a change in a density of the fluid using the first and the second pressure differences. In arrangements, the change in density may be estimated by the equation, $\Delta\rho=(\Delta P_{before_influx}-\Delta P_{after_influx})/(g\times\Delta TVD)$, wherein $\Delta P$ is a fluid pressure difference between a first and second point along the wellbore, $\rho$ is a mean value of density of the fluid between the first and the second point, g is gravity and $\Delta TVD$ is a vertical distance between the first and the second point. The method may also include estimating an inclination along the wellbore, and estimating a change in the density using the estimated inclination. An exemplary apparatus deployed in connection with the method may include at least two axially spaced apart pressure sensors to estimate the first and the second pressure differences. In one arrangement, the method may further include the steps of switching the positions of the two pressure sensors; measuring pressure with the two pressure sensors in their switched positions; estimating a correction term using the pressure measurement of the two pressure sensors in their switched and unswitched positions; and applying the estimated correction term to the measurements of the pressure sensors to reduce a relative offset between the two pressure sensors.

For drilling related applications, the method may include positioning the two pressure sensors on a drill string; and drilling the wellbore with the drill string. A method for such applications may include the steps of conveying a processor with a drilling string into a wellbore. The processor may be programmed to estimate the change in the density of the fluid. The method may further include instituting a corrective action for controlling a fluid flow in the wellbore in response to an estimated change in density. Exemplary corrective actions include: (i) sealing off the well to stop fluid flow, (ii) circulating a loss circulation material, (iii) changing a mud weight of a drilling fluid circulated in the wellbore.

From the above, it should be appreciated that what has been disclosed includes, in part, a method for detecting a change in a fluid in a wellbore that includes estimating a change in a density of the fluid in the wellbore using four or more measured pressures in the fluid. The measured pressures may include a first set of pressures measured at a first time and a second set of pressures measured at a second time different from the first time. The method may further include estimating a first pressure difference using the first set of pressures and estimating a second pressure difference using the second set of pressures. The density may be estimated using the estimated first and second pressure differences.

From the above, it should be appreciated that what has been disclosed includes, in part, a computer-readable medium for detecting a change in a fluid in a wellbore. The medium may include instructions that enable at least one processor to: estimate a first and a second pressure difference in the fluid in the wellbore; and estimate a change in a density of the fluid using the first and the second pressure differences. The instructions may estimate the change in density in part by using the equation, $\Delta\rho=(\Delta P_{before_influx}-\Delta P_{after_influx})/(g\times\Delta TVD)$, wherein $\Delta P$ is a fluid pressure difference between a first and second point along the wellbore, $\rho$ is a mean value of density of the fluid between the first and the second point, g is gravity and $\Delta TVD$ is a vertical distance between the first and the second point.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

We claim:

1. A method for detecting a change in a fluid in a wellbore, comprising:

estimating a first pressure difference in the fluid in the wellbore between a first point and a second point along the wellbore;

estimating a second pressure difference in the fluid in the wellbore between the first point and the second point along the wellbore; and estimating a change in a density of the fluid using the first and the second pressure differences.

2. The method according to claim 1, wherein the change in density is in part estimated by the equation, $\Delta\rho=(\Delta P_{before\ influx}-\Delta P_{after\ influx})/(g\times\Delta TVD)$, wherein $\Delta P$ is a fluid pressure difference between the first and second point along the wellbore, $\rho$ is a mean value of density of the fluid between the first and the second point, g is gravity and $\Delta TVD$ is a vertical distance between the first and the second point.

3. The method according to claim 1, further comprising estimating an inclination along the wellbore, and estimating a change in the density using the estimated inclination.

4. The method according to claim 1, further comprising measuring a pressure in the fluid using at least two axially spaced apart pressure sensors to estimate the first and the second pressure differences.

5. The method according to claim 4, further comprising: switching the positions of the two pressure sensors; measuring pressure with the two pressure sensors in their switched positions; estimating a correction term using the pressure measurement of the two pressure sensors in their switched and unswitched positions; and applying the estimated correction term to the measurements of the pressure sensors to reduce a relative offset between the two pressure sensors.

6. The method according to claim 1, further comprising: positioning the two pressure sensors on a drill string; and drilling the wellbore with the drill string.

7. The method according to claim 1, further comprising: conveying a processor with a drilling string into a wellbore, wherein the processor is programmed to estimate the change in the density of the fluid.

8. The method according to claim 1, further comprising instituting a corrective action for controlling a fluid flow in the wellbore in response to an estimated change in density.

9. The method according to claim 8, wherein the corrective action is one of: (i) sealing off the well to stop fluid flow, (ii) circulating a loss circulation material, (iii) changing a mud weight of a drilling fluid circulated in the wellbore.

10. A method for detecting a change in a fluid in a wellbore, comprising:

estimating a change in a density of the fluid in the wellbore using a first set of measured pressures in the fluid at a first point and a second point in the wellbore at a first time and using a second set of measured pressures in the fluid at the first point and the second point in the wellbore at a second time.

11. The method of claim 10 further comprising estimating a first pressure difference using the first set of pressures and estimating a second pressure difference using the second set of pressures, wherein the density is estimated using the estimated first and second pressure differences.

12. The method according to claim 10, wherein the change in density is in part estimated by the equation, $\Delta\rho=(\Delta P_{before\ influx}-\Delta P_{after\ influx})/(g\times\Delta TVD)$, wherein $\Delta P$ is a fluid pressure difference along the wellbore at the first time and the second time, $\rho$ is a mean value of density of the fluid between a first and a second point at which the first pressure difference and the pressure difference are estimated, g is gravity and $\Delta TVD$ is a vertical distance between the first and the second point.

13. The method according to claim 10, further comprising estimating an inclination along the wellbore, and estimating a change in the density using the estimated inclination.

14. The method according to claim 10, further comprising using at least two axially spaced apart pressure sensors to estimate the first and second sets of measured pressures.

15. The method according to claim 14, further comprising: switching the positions of the two pressure sensors; measuring pressure with the two pressure sensors in their switched positions; estimating a correction term using the pressure measurement of the two pressure sensors in their switched and unswitched positions; and applying the estimated correction term to the measurements of the pressure sensors to reduce a relative offset between the two pressure sensors.

16. A computer-readable medium for detecting a change in a fluid in a wellbore, the medium comprising:

instructions that enable at least one processor to:

estimate a first pressure difference in the fluid in the wellbore between a first point and a second point along the wellbore;

estimate a second pressure difference in the fluid in the wellbore between the first point and the second point along the wellbore; and estimate a change in a density of the fluid using the first and the second pressure differences.

17. The medium according to claim 16, wherein the instructions estimate the change in density in part by using the equation, $\Delta\rho=(\Delta P_{before\ influx}-\Delta P_{after\ influx})/(g\times\Delta TVD)$, wherein $\Delta P$ is a fluid pressure difference between a first and second point along the wellbore, $\rho$ is a mean value of density of the fluid between the first and the second point, g is gravity and $\Delta TVD$ is a vertical distance between the first and the second point.

18. The medium according to claim 16, wherein the instructions estimate an inclination along the wellbore, and estimating a change in the density using the estimated inclination.

19. The medium of claim 16 wherein the medium comprises at least one of: (i) a ROM, (ii) an EPROM, (iii) an EEPROM, (iv) a flash memory, and (v) an optical disk.

* * * * *